United States Patent [19]

DuBois

[11] Patent Number: 4,478,406

[45] Date of Patent: Oct. 23, 1984

[54] APPARATUS FOR SORTING PHOTOCOPIES

[75] Inventor: R. Clark DuBois, Fairfield, Conn.

[73] Assignee: Gradco Systems, Inc., Santa Ana, Calif.

[21] Appl. No.: 391,795

[22] Filed: Jun. 23, 1982

[51] Int. Cl.[3] ..... B65H 39/11

[52] U.S. Cl. ..... 271/293; 271/296

[58] Field of Search ..... 271/293, 296, 294, 292, 271/295

[56] References Cited

U.S. PATENT DOCUMENTS

| | | | |
|---|---|---|---|
| 3,516,654 | 6/1970 | Mestre | 271/296 X |
| 3,774,902 | 11/1973 | Schulze | 271/293 |
| 3,848,868 | 11/1974 | Stemmle | 271/293 X |
| 4,133,522 | 1/1979 | Siegl | 271/293 X |
| 4,328,963 | 5/1982 | DuBois | 271/293 |
| 4,332,377 | 6/1982 | DuBois | 271/293 |
| 4,343,463 | 8/1982 | Lawrence | 271/294 X |

*Primary Examiner*—Richard A. Schacher

*Attorney, Agent, or Firm*—Newton H. Lee, Jr.

[57] ABSTRACT

An improvement in the mechanism for separating sheet-receiving trays of a sorter for photocopy machines, which increases the capacity of the sorter. A plurality of drive cams each sliding up and down on its own drive shaft, and each having a helical slot on its outer surface, rotate as the shafts are rotated. Trunions extending from the trays engage the helical grooves in the cams, and they, along with the tray to which they are connected, move up or down as the cams rotate. The sorter has improved capacity while yet permitting access between trays. It is simple and positive in operation and provides sorting action in both the upward and downward movement of the cams on the driveshafts.

7 Claims, 6 Drawing Figures

APPARATUS FOR SORTING PHOTOCOPIES

BACKGROUND OF THE INVENTION

Apparatus and processes for producing photocopies are well known in the art, and the art is also well-developed with regard to devices for receiving, stacking and sorting the sheets as they are discharged from the photocopy machine. U.S. Pat. Nos. 3,721,435, 4,203,587, 3,788,640 and 3,774,902 are relevant, as is my co-pending application Ser. No. 98,546 filed on Nov. 29, 1979, now U.S. Pat. No. 4,328,963.

In the sorting and stacking devices of the prior art, however, the trays which receive the sheets generally move so that the paper entry point (i.e., the discharge point from the machine) is always the same. Such devices are complicated, because they require that the entire stack of trays be movable.

SUMMARY OF THE INVENTION

In the present invention, a relatively fixed stack of trays provides the advantage that virtually the entire vertical height of the sorter can be used for a supply of trays and, therefore, increase the number of sheets which can be handled at a given time. At any one moment, one tray will be wide open to receive a sheet of paper discharged from the copy machine, and that they need not be in alignment with the discharge chute of the copier. All the other trays will be in their compressed spacing.

The critical aspect of the tray driving mechanism of the present invention involves the principle of a plurality of drum-shaped cams having central openings therethrough which are irregularly shaped (i.e., square or star-shaped or any shape other than circular), and arranged to slide up and down on a similarly shaped post. Under these circumstances, the cams rotate as the shafts rotate, but the cam can slide along the length of the shaft. Each cam has a helical groove in its outer surface, and trunions, affixed to the sides of the paper-receiving trays, follow in the grooves of the cams as the cams and shafts rotate. This causes a separation between the trays immediately above and below the cams while keeping all the rest of the trays stacked adjacent to the aforementioned pair of trays.

Therefore, an object of the present invention is to provide a more compact sheet-sorter for photocopy machines.

Another object of the present invention is to provide a positive driving action, separating the trays in a stack of trays, to provide an opening to receive a sheet discharged from a photocopy machine.

Another object of the present invention is to provide a sorting and stacking device for a photocopy machine which provides easy access to the stack of trays in case of a disorder in the operation of the machine.

With the above and other objects in view, a better understanding of the present invention can be ascertained by reference to the attached specification.

DETAILED DESCRIPTION

For the purpose of illustrating the invention, there is shown in the accompanying drawings a form thereof which is at present preferred, although it is to be understood that the various instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
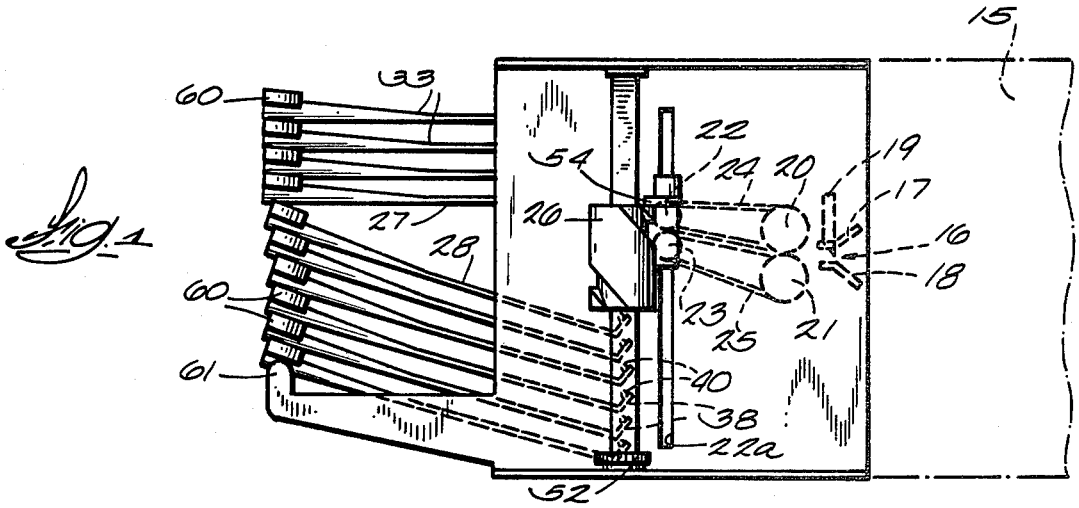
FIG. 1 is a side elevational view of the sorter of the present invention.

Referring now to FIG. 1, a photocopier 15 has a discharge port 16 through which a sheet of paper passes from the photocopier. The sheet is discharged through the guides 17 and 18, past the paper switch 19 between the rollers 20 and 21, which, with the rollers 22 and 23, guide the elastic belts 24 and 25.

The rollers 22 and 23 are guided in appropriate slots 22-a in the side frame and move up and down with the helical cams 26 so that the paper sheet discharged from the copy machine will be guided by the elastic belts 24 and 25 between the rollers 22 and 23 into the gap (between the paper-receiving trays) created by the positioning of the tray 27(above the cam 26) and the tray 28(below the cam 26).

The belts 24 and 25 are elastic and stretch between their respective guide rollers, as the rollers 22 and 23 rise or fall in the guide slots/22-*a*.

Figure 6:
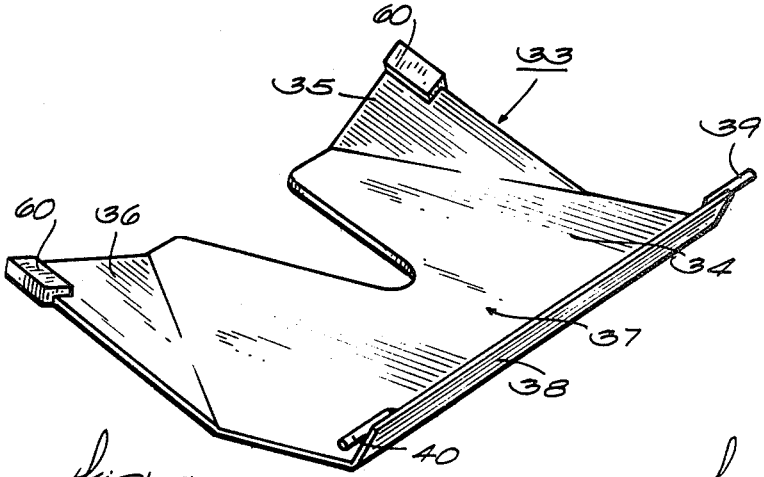
FIG. 6 is a perspective view of one of the trays of the sorter of the present invention.

Referring now to FIG. 6, one sees a tray 33 having a generally flat portion 34 and shaped wings 35 and 36.

The paper is discharged into the tray in the direction shown by the arrow 37 with the leading edge of the paper extending beyond the wings 35 and 36. The wings 35 and 36 give the sheet a slight curvature and provide a stiffening effect and prevent the paper from dropping beyond the outermost ends of the wings 35 and 36. The flat portion 34 has a lip 38 which prevents the paper from sliding rearwardly after it is discharged into the tray.

Also disposed on the lip 38 are a pair of trunions 39 and 40 which are guided in slots 29 and 30.

At the outermost ends of the wings 35 and 36 are pads 60 which are thicker than the material of the wings so as to separate the trays as shown in FIG. 1. The lowermost pair of pads 60 on the lowermost tray rest on supports 61. The size and shape of the pads 60 and the location of the support 61 insure that the trays above the cams 26 are generally horizontal.

The force of gravity tends to rotate the trays 33 in the direction shown by the arrow 45, thus causing the outer ends of the trays to stack up on the pads 60 on top of the support 61.

It is to be understood that the disposition of the slots 29, the trunions 39 and 40, the pads 60 and the support 61 can be such that the upper trays may be disposed horizontally (as shown) or inclined either upwardly or downwardly, if desired.

Figure 5:
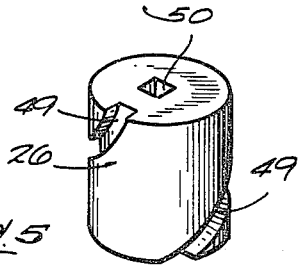
FIG. 5 is a perspective view of one of the cams showing the trunion-guiding groove therein.

With reference now to FIG. 5, it can be seen that each of the cams has a slot 49 which engages a respective trunion. In addition, the cams have a square (or other non-circular shape) central hole 50 through which a shaft 51 fits. A gear or similar drive mechanism 52 at one end of the shaft 51 causes the shaft to rotate, thus causing the attached cam to rotate. When the cam slot 49 engages a trunion (as the shaft 51 rotates in one direction), it will engage the trunion on the tray directly beneath the cam and move the trunion and upwardly. When the shaft rotates in the other direction, it will engage the trunions on the tray directly above the cam and move that tray downwardly.

During such rotation of the shafts 51, the cams either "crawl" up or down the shafts, depending upon the respective rotation of the shaft.

Figure 2:
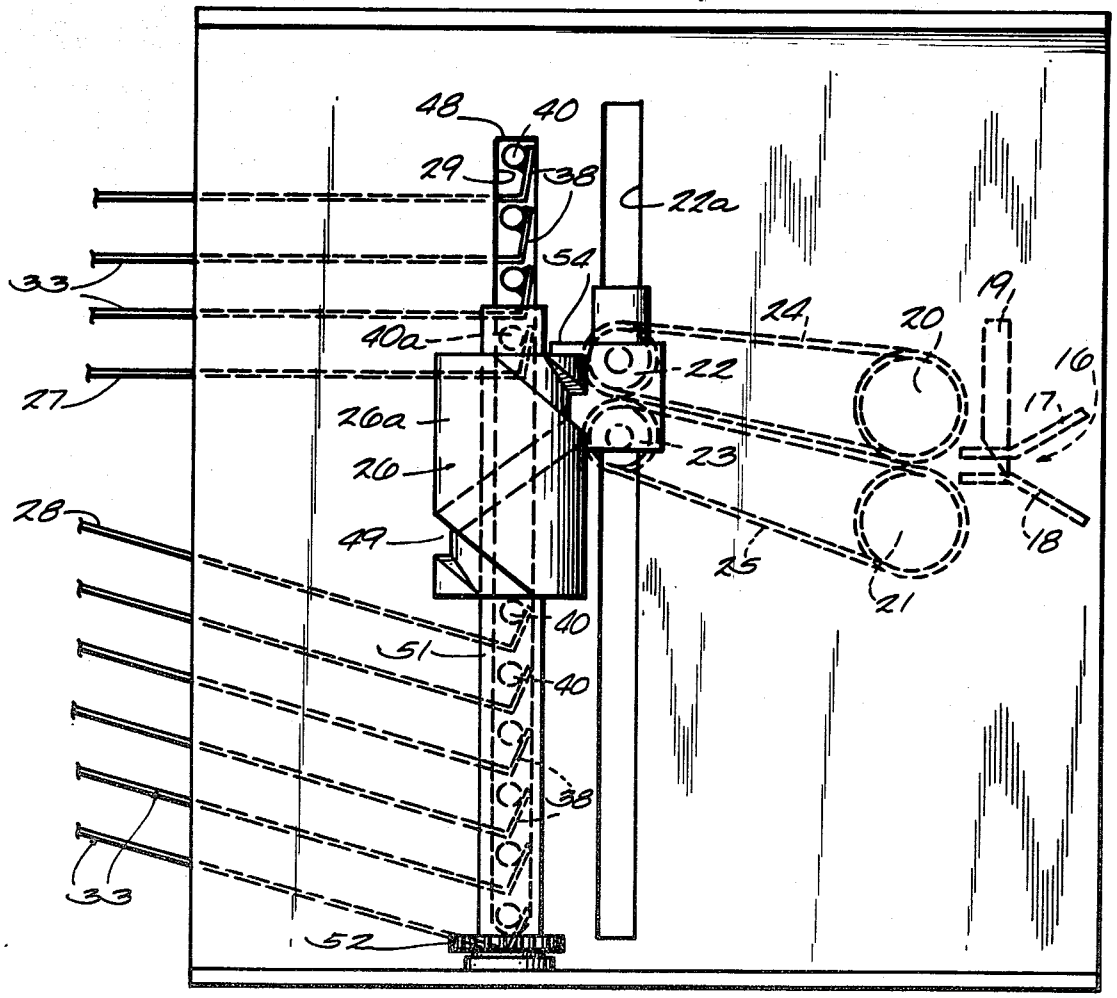
FIG. 2 is a detailed view of the stack of trays, a pair of cams and the paper conveyor.
Figure 3:
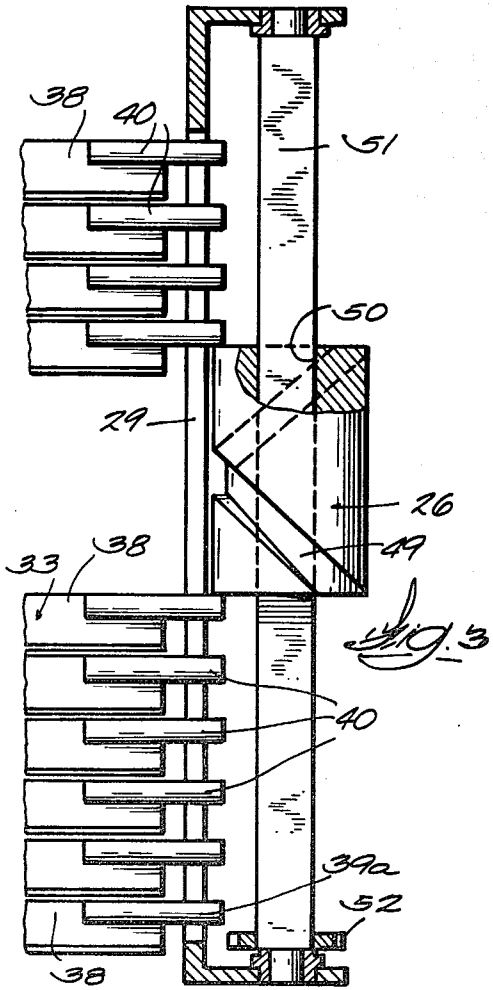
FIG. 3 is an end elevational view of a cam shown in operative juxtaposition to the trunions of the paper-receiving trays.

As can be seen particularly in FIG. 2, the trays are spaced by the larger diameter of the trunions on the tray-side of the frame, thus providing the proper separation of the trays, while yet providing the proper diameter of the trunion to engage the slot 49 and the respective cam.

As is also seen in FIG. 2, the outer ends of the upper trays can be lifted to permit access to the contents of the trays.

The drive mechanism for the respective elements is not shown in detail, but in the embodiment shown in FIG. 1, the driver rollers 20 and 21 can be separately driven by motor elements (not shown) within the housing of the sorter.

Figure 4:
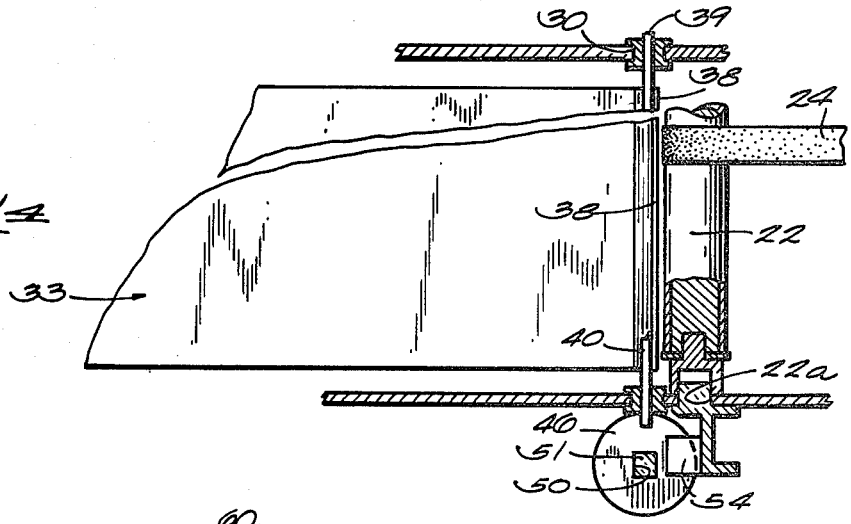
FIG. 4 is a top fragmentary view of a pair of cams and one of the paper-guiding rollers.

With reference to FIG. 4, the trunion 39 is shown in juxtaposition with its respective cam 26 and a yoke 54 rests upon the upper surface of the cam. Thus the pair of guide rolls 22 and 23 move up and down with the rise and fall of the cams and the sheet of paper is always discharged into the gap between the trays 27 and 28.

Although the distance between the rollers 22 and 23 changes in respect to the rollers 20 and 21, the elasticity of the belts 24 and 25 accommodates such change and the paper is always discharged directly into the gap between the trays 27 and 28.

Although I have shown the groove in the cams as having but one revolution of a fixed pitch groove, in reality this will be a more sophisticated cam shape having a sine curve. It is also to be understood that the curve could be more or less than one revolution, as is desired in the actual construction.

Understandably, both of the shafts 51 are driven at the same time so as to rotate the cams 26 to transfer a tray from an upper to a lower position, or from a lower to an upper position depending upon the direction of rotation. During the operation, and helical cams slide vertically on the square posts, their location being controlled by a stack of trays either above or below the cams.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. In a sheet-sorter
a plurality of sheet-receiving trays,
a pair of trunnions on each tray one trunnion projecting from each side of the tray,
a pair of rotatable drum-cams, each in operative juxtaposition to a trunnion and spacing the trays from one another,
a spiral slot in each cam for receiving the trunnions,
a rotatable shaft for each cam,
each cam having a central hole to receive one of said shafts, said shaft and said hole being non-circular whereby said cams are rotatable by said shafts and slide longitudinally on said shafts,
means for rotating said shafts to cause said trunnions to be successively received in said spiral slots in said cams to move said cams longitudinally along said shafts to successively form a gap between adjacent trays at opposite ends of said cams.

2. The sheet-sorter of claim 1 including sheet-feeding means to guide a sheet into the gap.

3. The sheet-sorter of claim 2 wherein the sheet-feeder includes an upper elastic belt and a lower elastic belt,
each belt traveling around an in-feed roller and an out-feed roller,
the in-feed rollers disposed in fixed position,
the out-feed rollers movable in unison with the cams so that the sheet discharged from between the said out-feed roller is in alignment with the said gap.

4. The sheet-sorter of claim 1 wherein all trays are pivotable about the trunions to provide access to space between said trays.

5. The sheet-sorter of claim 1 including spacers at the outer end of each tray, said spacers arranged to rest upon each other and upon a support means whereby a create sheet-receiving spaces between the trays.

6. A sheet sorting machine comprising: a frame structure, a plurality of trays in said frame structure arranged in a stack and having laterally spaced trunnions projecting from opposite sides of said trays at an inner end thereof, said trays being pivotally mounted one on the other at their outer ends, rotary travelling tray opening means engaged with said trunnions and operable to engage and space the inner ends of adjacent trays and to move from tray to tray in response to rotative engagement thereof with said trunnions, said traveling tray opening means including a pair of cams at opposite sides of said frame structure, and means for driving said cams while allowing them to travel on said trunnions.

7. A sheet sorting machine as defined in claim 6, including a sheet infeed leading to said trays and movable with said travelling tray opening means.

* * * * *